United States Patent [19]

Cainaud

[11] 4,065,022

[45] Dec. 27, 1977

[54] CISTERN CONTAINER

[75] Inventor: Henri Cainaud, Talant, France

[73] Assignee: Societe des Establissements Hugonnet, Paris, France

[21] Appl. No.: 768,561

[22] Filed: Feb. 14, 1977

[30] Foreign Application Priority Data

Mar. 5, 1976 France ..... 76.06348

[51] Int. Cl.[2] ..... B65D 7/42; A47G 23/02

[52] U.S. Cl. ..... 220/71; 248/146; 220/1 B

[58] Field of Search ..... 220/71, 1 B, 5 A, 23.2, 220/85 S, 72; 248/146, 154

[56] References Cited

U.S. PATENT DOCUMENTS

| | | | |
|---|---|---|---|
| 2,124,441 | 7/1936 | Thwaits | 220/5 A X |
| 2,463,880 | 3/1949 | Jones | 220/1 B |
| 2,870,982 | 1/1959 | Greene et al. | 248/146 |

*Primary Examiner*—William Price
*Assistant Examiner*—Steven M. Pollard
*Attorney, Agent, or Firm*—Staas & Halsey

[57] ABSTRACT

A cistern container assembly comprising a cistern, a frame having a number of semi-circular cradles on which the cistern rests, and a similar number of external reinforcing hoops on the cistern, each hoop corresponding to an associated one of said cradles, each reinforcing hoop being U-sectioned to provide an external groove which receives a U-sectioned ring of resilient material, and each cradle engaging in the external groove of the associated reinforcing hoop. Half collars extend partially around the hoops and are attached to the frame by adjustable links and tightening devices to secure the cistern in the semi-circular cradles.

13 Claims, 7 Drawing Figures

CISTERN CONTAINER

BACKGROUND OF THE INVENTION

This invention relates to cistern container assemblies which, as is known, are made up of a cistern, generally cylindrical, and a parallelepipedonal frame, enclosing the cistern on all sides and arranged in such a manner as to permit maintenance and stacking of the assembly.

During their use, these assemblies are subject to very varying demands, whether on ships, rail and road vehicles, or in warehouses. Essentially, the object of this invention is the installing of the cistern in the frame in such a manner that stresses and shocks to which the assembly may be subjected do not have unfavourable repercussions on the cistern.

SUMMARY OF THE INVENTION

According to the invention there is provided a cistern container assembly comprising a frame having a number of substantially semi-circular cradles in which the cistern rests, wherein the cistern is provided with a similar number of external reinforcing hoops each having an external groove in which resilient padding is located and in each of which grooves a corresponding cradle engages.

The resilient padding preferably comprises a ring of resilient material, such as rubber, encircling each said hoop and located within said external groove thereof.

The cistern may be secured in said semi-circular cradles by a number of half-collars extending partially around said hoops respectively and attached to said frame.

Preferably, the hoops, the resilient padding, the half-collars are of generally U-shaped cross-section and fit one into the other in such a manner that forces between the cistern and container are absorbed not only in a radial direction but also in a longitudinal direction.

The resilient padding between the cistern and the cradles may also provide thermal insulation of the cistern in relation to the frame.

It may also permit expansion of the cistern in a longitudinal direction and in a radial direction as well as absorbing harmful vibrations to the cistern and its fittings.

The invention has a particular application for cisterns with internal linings, for example, of ebonite or enamel, as well as those which are used for the carrying of dangerous products such as acids and alkalis, since it reduces the risk of leakage, and hence corrosion, under stress.

The following description, with the aid of accompanying drawings, presented by way of example, will facilitate the understanding of how the invention can be achieved.

DESCRIPTION OF THE PREFERRED EMBODIMENT

Figure 1:
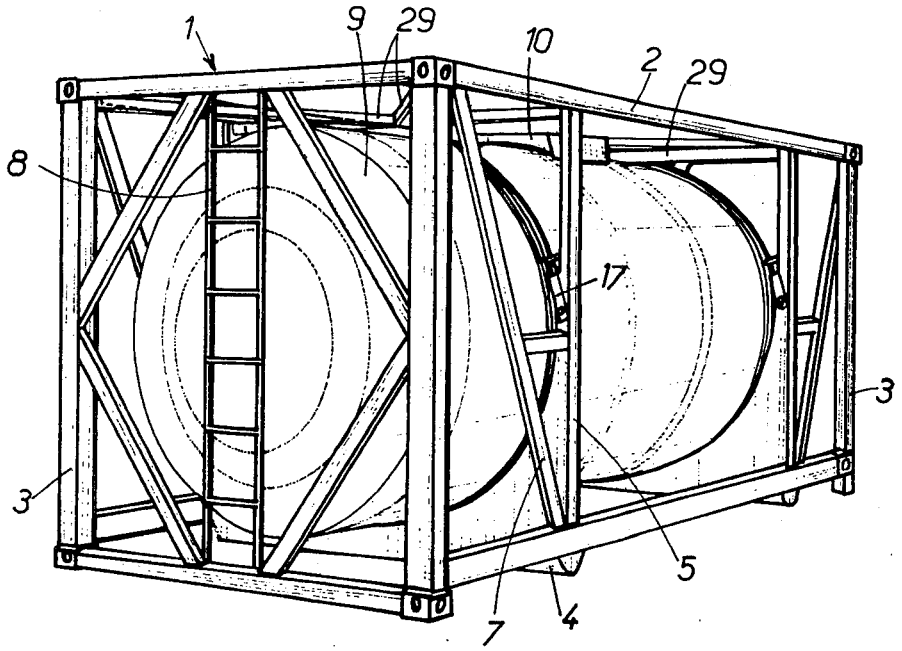
FIG. 1 is a general perspective view of a cistern container assembly in accordance with the invention.

In the example illustrated in the drawings the cistern container assembly includes a frame 1 of a parallelepipedonal shape, made up of longitudinal beams 2 welded to end frames 3 and joined by lower horizontal cross members 4 and vertical members 5. Inclined struts 6 and 7 act as stiffeners in such a manner as to produce a robust and rigid assembly. The various elements of the frame are preferably hollow and of rectangular or square cross-section.

The frame 1 is intended to be disposed horizontally, as shown in FIG. 1, either on a frame or on a similar container. It features one or more ladders 8 which allow access to the upper side of the frame. The upper side of the frame is open in such a way that the cistern 9 can be passed through it so that the frame surrounds the cistern and protects it.

Figure 2:
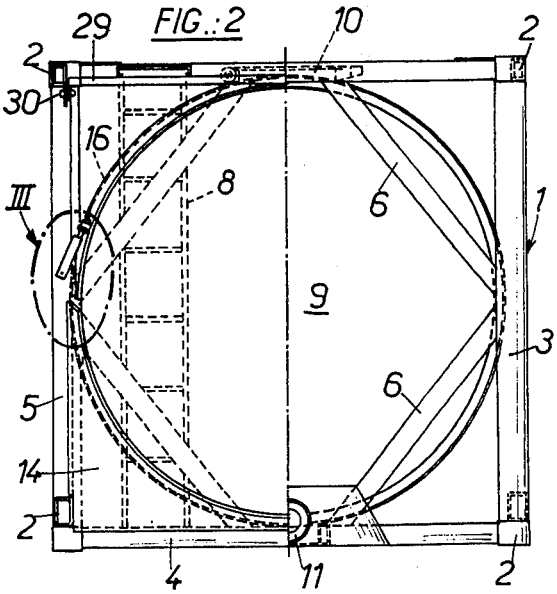
FIG. 2 is a view of a cross section through the end of the cistern container assembly.

The cistern can be of the standard type, for example cylindrical with rounded ends. It features notably an upper inlet 10 and a tubular outlet 11 at the bottom (FIG. 2).

The cistern is provided, for example at two points adjacent its ends, with hoops 12 incorporating a wide external groove. For example, the hoops may comprise, as best seen in FIG. 5, U-sectioned channels attached by their webs to the cistern, the ends 13 of the flanges of the channels being turned outwardly away from one another at right angles.

Figure 3:
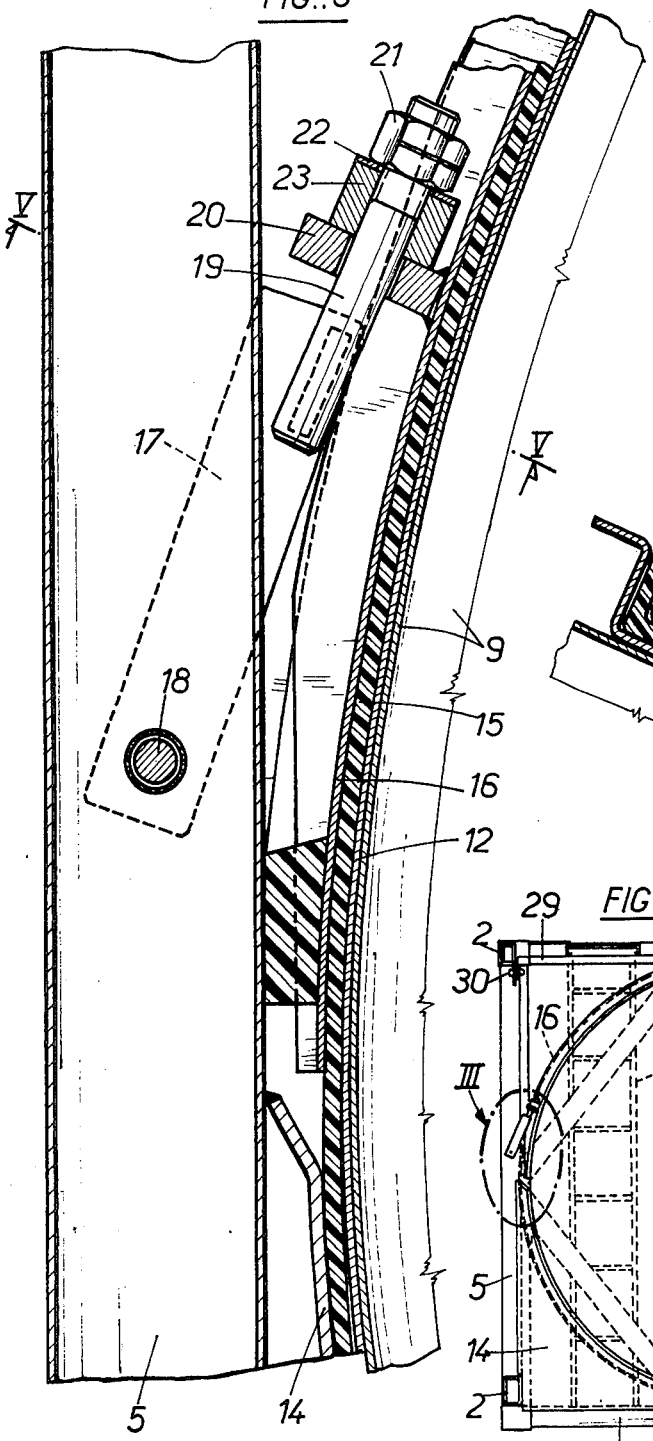
FIG. 3 is a cross sectional view on a larger scale of the detail III of FIG. 2.
Figure 7:
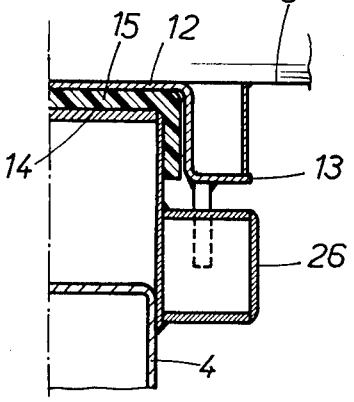
FIG. 7 is a section along line VII—VII of FIG. 6.

The hoops 12 serve to hold the cistern in the frame 1 which can be done as shown in detail in FIGS. 3 and 7, or in an equivalent manner.

Between two of the uprights 5 facing each other and above the corresponding cross-piece 4, cradles 14 of substantially semi-circular shape are welded to the frame 1. These cradles present upwardly facing semi-cylindrical supporting surfaces, the axis of each supporting surface substantially coinciding with the longitudinal axis of the frame. The width of each supporting surface, in the axial direction, is less than the internal width of the hoops 12, and the radius of each supporting surface is a little larger than that of the bottoms of said hoops. Furthermore, the spacing of the cradles 14 is such that after the cistern 9 is put into the frame, the lower parts of the hoops just fit over the cradles respectively as best seen in FIG. 7.

Figure 5:
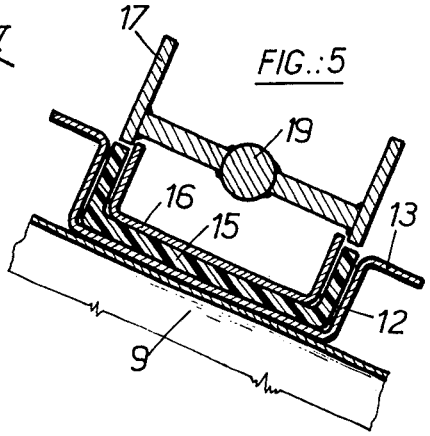
FIG. 5 is a section along line V—V of FIG. 3.

The hoops 12 are fitted internally with resilient padding, in the form of rings 15 made of rubber or an equivalent elastomer, which rings feature a U-shaped cross section as shown in FIG. 5 and cover the bottoms and the flanges of the hoops, the dimensions of the rings being such that the cradles 14 can be fitted with slight play into the rings when the cistern is positioned in the frame. The rings 15 can, for example, be positioned in the hoops by stretching because of their elasticity.

The cistern, once positioned, is held in the cradles 14 by half-collars 16, also U-shaped in cross-section, the width and radius of which are in effect the same as those of the cradles 14. These half-collars are engaged in the upper parts of the rings 15, as can be particularly seen from FIGS. 3 and 5.

Figure 4:
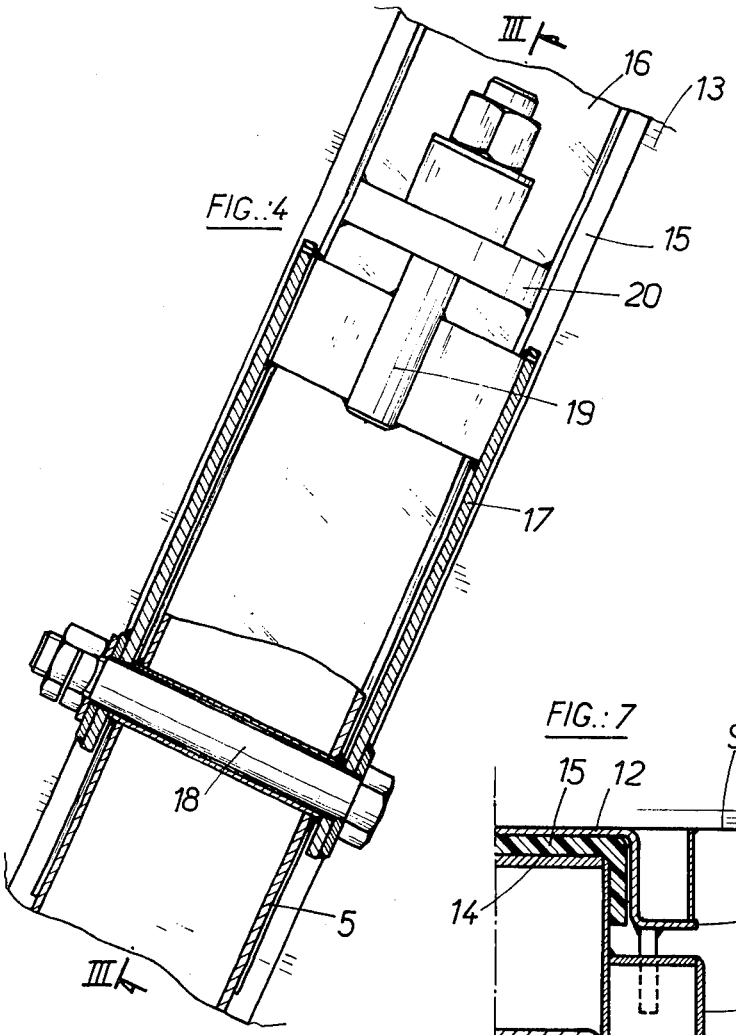
FIG. 4 is an elevation corresponding to FIG. 3, the frame having been removed.

The half-collars 16 are attached to the frame 1 on each side by means of adjustable links 17 connected to the uprights 5 respectively for pivotal movement about longitudinal axes 18. Each link 17 features a pin 19 which passes through an appropriate hole in a robust cross-piece 20 welded to the half-collar, and has a threaded end portion engaged by a nut 21. A washer 22 and a resilient sleeve 23 encircle the pin 19 between the nut 21 and the cross-piece 20 (see FIGS 3 and 4). Thus each half-collar 16 may be tightened by screwing down the nut 21. This tightning is preferably of a moderate order.

The ends of the half-collars 16 are bevelled, as shown on FIG. 3, and furnished with supporting blocks 24, made of neoprene or an equivalent elastomer, which are compressed against the uprights 5, according to the degree of tightening of the nuts 21, in order to provide supplementary shock absorption.

Figure 6:
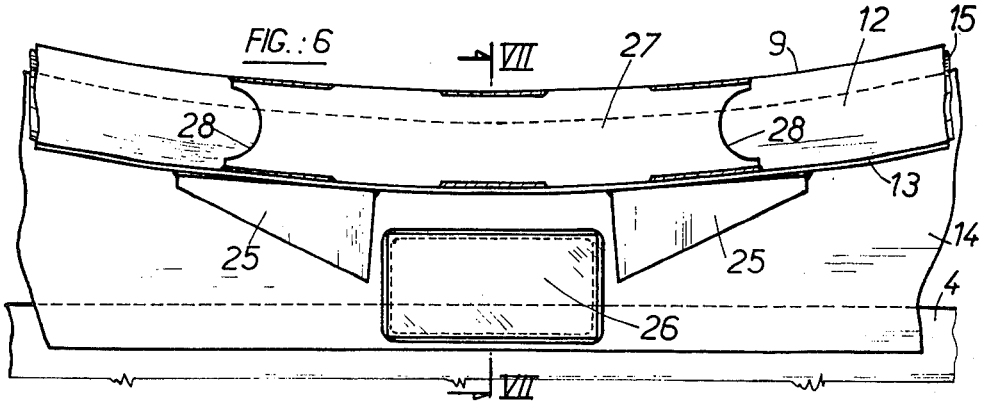
FIG. 6 is a partial elevation showing the centring device of the cistern in relation to the frame.

To prevent the cistern 9 rotating on its axis and at the same time avoiding distortion, one of the hoops 12 has outwardly projecting vanes 25, which can be seen on FIGS. 6 and 7, and which are located on either side of a thrust block 26 welded to the corresponding cradle 14. At this location the hoop 12 is stiffened by a gusset 27 welded to the cistern 9 and to the adjacent flange 13, the ends 28 of the gusset being notched in a half-moon shape in order to prevent the cistern distorting whilst being welded (FIG. 6).

Once the cistern has been positioned in the frame, the open upper side of the frame is closed by means of movable parts 29 fastened by bolts 30 (FIG. 2) to the beams 2 and the end frames 3. The parts 29 consist of cross-pieces which go over the half-collars 16 thus protecting them from shocks. The cross-pieces can feature an attachment (not shown) allowing access to the inlet 10 of the cistern by using the ladder 8.

The described assembly method is only one example of the invention and it may be modified, by the substitution of equivalent techniques, without departing from the scope of the invention as defined by the appended claims.

I claim:

1. A cistern container assembly comprising: a cistern; a frame; a number of substantially semi-circular cradles in the frame on which cradles the cistern rests; a similar number of external reinforcing hoops on the cistern, each hoop corresponding to an associated one of said cradles; an external groove in each reinforcing hoop; and resilient padding means located in each of said grooves; each cradle engaging in the external groove of the associated reinforcing hoop.

2. A cistern container assembly according to claim 1, wherein each groove is of outwardly-facing U-shaped cross-section.

3. A cistern container assembly according to claim 2, wherein each hoop is of channel section and comprises a web and two flanges, the web of the channel being attached to the cistern and the flanges of the channel extending outwardly, said flanges having end portions turned at right angles away from one another.

4. A cistern container assembly according to claim 2, wherein said resilient padding means comprise elements of outwardly-facing U-shaped cross-section.

5. A cistern container assembly according to claim 1, wherein said resilient padding means comprise a ring of resilient material encircling each said hoop and located within said external groove thereof.

6. A cistern container assembly according to claim 1, wherein the cistern is secured in said semi-circular cradles by a number of half-collars extending partially around said hoops respectively and attached to said frame.

7. A cistern container assembly according to claim 6, wherein each half-collar engages in the external groove of a corresponding hoop on the cistern.

8. A cistern container assembly according to claim 6, wherein the half-collars are attached to the frame by means of adjustable links.

9. A cistern container assembly according to claim 8, wherein the adjustable links are pivotally connected to the frame and attached to the frame-collars by tightening devices.

10. A cistern container assembly according to claim 6, wherein the frame comprises uprights and the half-collars are attached to the uprights of the frame and include shock absorber blocks located between the ends of the half-collars and said uprights of the frame.

11. A cistern container assembly according to claim 6, wherein each half-collar is of outwardly-facing U-shaped cross-section.

12. A cistern container assembly according to claim 6, wherein the upper side of the frame can be closed, after the cistern has been put in place, by means of movable parts having cross-pieces which protect the half-collars.

13. A cistern container assembly comprising: a cistern; a frame; a number of substantially semi-circular cradles in the frame on which cradles the cistern rests; a similar number of external reinforcing hoops on the cistern, each hoop corresponding to an associated one of said cradles; an external groove in each reinforcing hoop; a ring of resilient material located in each of said grooves; each cradle engaging in the external groove of the associated reinforcing hoop; a number of half-collars extending partially around said hoops and attached to said frame; each half collar engaging in the external groove of a corresponding hoop on the cistern; adjustable links pivotally connected to said frame; and tightening devices attaching the adjustable links to the half-collars respectively.

* * * * *